United States Patent [19]

Hasegawa et al.

[11] 3,955,383

[45] May 11, 1976

[54] SIGNAL GENERATOR FOR CIRCULAR PATTERN KNITTING MACHINES

[75] Inventors: Junzo Hasegawa, Aichi; Susumu Kawabata, Nagoya; Yasuhiko Suzuki, Nagoya, all of Japan

[73] Assignees: Kabushiki Kaisha Toyota Chuo Kenkyusho, Nagoya; Kabushiki Kaisha Toyoda Jidoshokki Seisakusho, Kariya, both of Japan

[22] Filed: Mar. 5, 1975

[21] Appl. No.: 555,435

[30] Foreign Application Priority Data

Mar. 14, 1974 Japan ..... 49-29447

[52] U.S. Cl. ..... 66/154 A

[51] Int. Cl.[2] ..... D04B 15/66

[58] Field of Search ..... 66/154 A, 50, 50 A, 66/50 B, 75, 56

[56] References Cited

UNITED STATES PATENTS

| | | | |
|---|---|---|---|
| 3,313,128 | 4/1967 | Schmidt et al. | 66/50 A |
| 3,313,129 | 4/1967 | Stock | 66/50 A |
| 3,561,232 | 2/1971 | Stock et al. | 66/50 R |
| 3,665,731 | 5/1972 | Groezinger | 66/50 R |
| 3,680,331 | 8/1972 | Morat | 66/154 A X |
| 3,745,791 | 7/1973 | Cuche | 66/50 A |
| 3,896,638 | 7/1975 | Gottschall | 66/50 R |

*Primary Examiner*—Ronald Feldbaum

*Attorney, Agent, or Firm*—Stevens, Davis, Miller & Mosher

[57] ABSTRACT

A synchronizing signal generator which supplies signals exactly synchronized with each of a series of needles mounted on a needle cylinder and rotating with said needle cylinder to actuate needle selector means of circular knitting machines with great accuracy, and includes first sensor means for producing signals synchronized with each cylinder needle rotating with said needle cylinder, second sensor means located in alignment with the first sensor means and for producing signals which represent the eccentric needle cylinder, difference operational circuit which processes those signals for difference operation, and a gain control circuit which controls the gain of the output of the difference operational circuit under the control of the signals produced by the second sensor means.

9 Claims, 17 Drawing Figures

SIGNAL GENERATOR FOR CIRCULAR PATTERN KNITTING MACHINES

BACKGROUND OF THE INVENTION

This invention relates to a synchronizing signal generator for circular pattern knitting machines, and more particularly to a signal generator which produces signals exactly synchronized with each of the cylinder needles mounted on a needle cylinder and rotating with the needle cylinder, said signals being applied to needle selector means of electronic circular pattern knitting machines.

Electronic circular pattern knitting machines are capable of knitting articles of various pattern at very high speeds, and have been used as industrial machines for mass production. It is known that circular knitting machines of this type have a needle cylinder having a series of knitting needles arranged at regular intervals for axial sliding movement, and needle selector means which selects cylinder needles according to desired knitting patterns during the high-speed rotation of the needle cylinder and controls the sliding movement of selected needles in axial direction between a knit or operative position for engaging the selected needles with thread and a welt or inoperative position. The known needle selector means includes an electromagnetic actuator which operates to select cylinder needles during the high-speed rotation of the cylinder, and has several different types.

For example, circular knitting machines have a needle cylinder diameter of 760 mm on which a series of about 2,100 needles are mounted and arranged at an extremely small pitch of about 1 mm. A very high-performance needle selector means is therefore required so that the selection of those cylinder needles arranged at such a small pitch and rotating at very high speeds may be carried out within an extremely short period of time and with great accuracy. In a well-known circular knitting machine, cylinder needles are moved at high speeds equivalent to several hundred cycles per second. The needle selector means provided in the circular knitting machine must meet the need of selecting cylinder needles within such very short period of time and with such accuracy, and therefore have limitations to the speed at which the machine should be rotated and its knitting capability. One of the very important factors that influence the property of the needle selector means is the occurrence of irregular reference input signals which are applied to the needle selector means. The needle selector means controls each cylinder needle based on reference input signals which are produced when each needle rotating with the needle cylinder has reached a predetermined position. Those reference input signals must be exactly synchronized with such cylinder needle or needle channel. It is known that suitable sensor means is employed for producing signals which are synchronized with such cylinder needle or needle channel. Photoelectric sensor means such as photo transistor, for example, is known which responds to variations in the light which is transmitted by moving objects. However, the known photoelectric sensor means is very susceptible of dusts from fiber materials when it is employed in circular knitting machines. When it is used in circular knitting machines which particularly require lubrication service, it must have an appreciably lower sensing capability. Other known sensor means include electromagnetic sensor means using electromagnetic elements such as high-frequency coil or element of magnetoresistance. This electromagnetic sensor means is intended for sensing variations in the gap between the sensor and an object. The sensor means is not affected by dusts or lubricated oil, and can be used as suitable means of sensing the movement of cylinder needles or cylinder channels and producing signals which are synchronized with the needles. It contributes largely to decreasing the occurrence of irregular reference input signals which are supplied to the needle selector means. Recently, the need is increasing for a very high speed circular knitting machine, and is followed by a problem as to a drawback that the electromagnetic sensor means has. The drawback is that needle synchronizing signals produced by the electromagnetic sensor contain errors due to the eccentricity or out-of-roundness (hereinafter referred to as "eccentric cylinder") of the needle cylinder. It is known that the needle cylinder comprises so many component parts which are individually machined and assembled. The needle cylinder is inevitably caused to deviate from its center because of the inaccuracy with those parts are machined and assembled. Therefore, the sensor cannot exactly operate due to errors caused by the eccentric needle cylinder. A signal produced by the sensor contains a part that represents any deviation of the cylinder from its center, said part appearing as an irregular part of the reference input signal at the needle selector means, and having a value of magnitude that cannot be disregarded in a high-speed circular knitting machine.

As noted above, the cylinder eccentric content of the signal arises when the needle cylinder deviates from its center, and has a frequency which is clearly lower than the needle synchronizing signal. It may appear that a known high-pass filter may be employed to separate that eccentric content from the needle synchronizing signal. However, in view of the different number of revolutions of the needle cylinder which includes a small number of revolutions ranging from low speed to almost standstill as it is starting or stopping, it will be understood that the use of a high-pass filter is not admittable since the high-pass filter will falsely remove the needle synchronizing signals at such low speeds.

SUMMARY OF THE INVENTION

The present invention has overcome those disadvantages earlier referred to, and provides advantages which will become apparent from the following specification.

It is therefore one object of the present invention to provide a synchronizing signal generator for use in a circular knitting machine and which includes means of separating the cylinder eccentric part due to the eccentric needle cylinder from a needle synchronizing signal, and of supplying an exact reference input signal to the needle selector means.

It is another object of the present invention to provide a synchronizing signal generator which includes difference operational means which removes the cylinder eccentric content of the needle synchronizing signal.

It is a further object of the present invention to provide a synchronizing signal generator which includes compensating means which compensates for variations that the needle synchronizing signal may have due to the eccentric needle cylinder.

BRIEF DESCRIPTION OF THE ACCOMPANYING DRAWING

DESCRIPTION OF THE PREFERRED EMBODIMENTS

Figure 1:
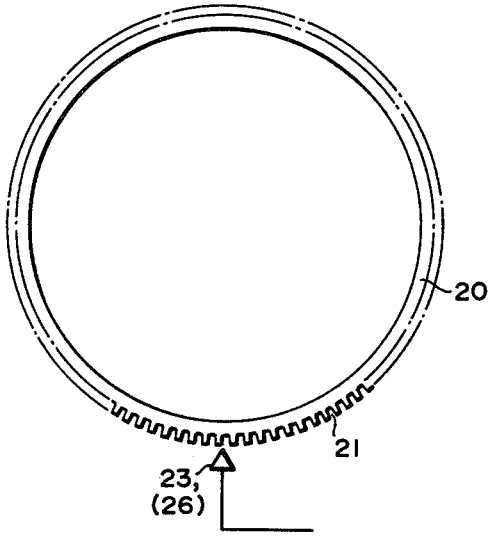
FIG. 1 is a top view showing sensor means located relative to the needle cylinder.
Figure 2:
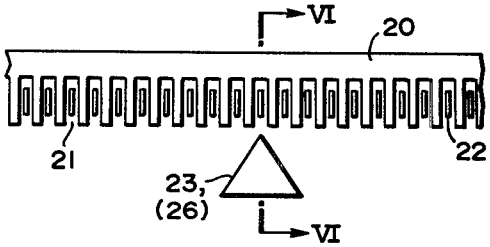
FIG. 2 is a partly enlarged view of FIG. 1.
Figure 3:
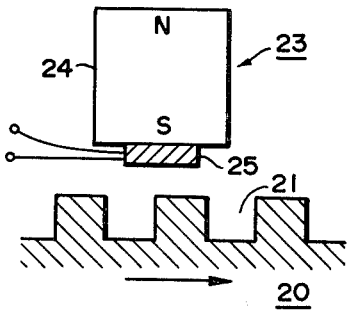
FIG. 3 is a schematic view showing sensor means including an element of magnetoresistance.

The invention will further be described by way of several preferred embodiments thereof with reference to the accompanying drawings in which:

Referring first to FIGS. 1 and 2, there is shown a needle cylinder 20 of a circular knitting machine, which is driven by drive means not shown to turn at very high speeds and has a series of needle grooves or channels 21 arranged on the periphery thereof, each of said needle grooves 21 having one needle 22 mounted therein for sliding movement in axial direction (perpendicular to the plane of the drawing). Synchronous sensor means 23 is located opposite the needle cylinder 20 and spaced in close proximity of the cylinder 20. The sensor means 23 should preferably include an element of magnetoresistance or high-frequency coil. FIG. 3 indicates sensor means 23 having an element of magnetoresistance 25 connected to one pole of a permanent magnet 24 and whose resistance varies with the magnetic flux density passing through the element 25. By providing the sensor means 23 in close proximity of the needle cylinder 20, it can respond to concave and convex surfaces of the needle grooves 21 to influence the magnet 24 so that it may have different magnetic flux distribution which changes the resistance of the element 25 accordingly, and supply signals that represent values of the resistance thus changed.

Figure 4A:
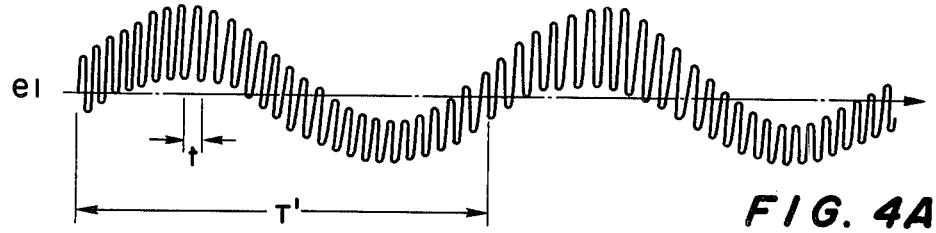
FIG. 4A, 4B, 4C, 4D, is a schematic view showing waveforms of signals for individual circuit elements.

When the circular knitting machine is turned on to rotate its needle cylinder, the sensor means 23 produces a signel *e*1 of a waveform shown in FIG. 4A. In FIG. 4A, time T is given as abscissa and voltage as ordinate. The signal *e*1 produced by the sensor means 23 comprises two parts, one representing a needle synchronizing signal of a period *t* and the other a "cylinder eccentricity" signal of a period T'. Given a total number M of cylinder needles, the relationship can be expressed by an equation $t = T'/M$. As seen from FIG. 4A, the signal *e*1 has a slowly undulating waveform formed by a series of cylinder eccentricity signals, and has levels whose center line is unstable. It is also shown that those needle synchronizing signals have different amplitudes varying with the motion of the undulating waveform. The waveform in FIG. 4A has a ridge formed by a series of needle synchronizing signals of greater amplitude. This shows that the sensor means 23 has its better sensitivity when the gap between the sensor and the needle cylinder is smaller. It has a trough formed by a series of needle synchronizing signals of smaller amplitude. This shows that the sensor means 23 has its lower sensitivity when the gap is greater. As noted above, irregular needle synchronizing signals occur if signals e1 produced by the sensor means 23 include such waveform and amplitudes as shown in FIG. 4A.

Figure 4B:
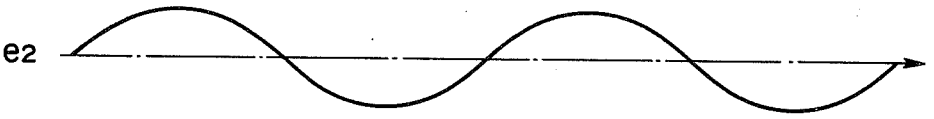
Figure 4C:
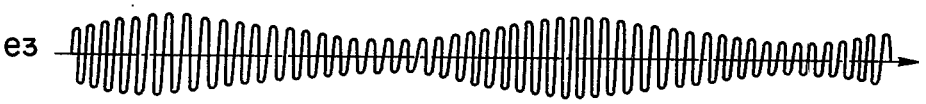
Figures 5A, 5B, 5C, 5D, 5E, 5F:
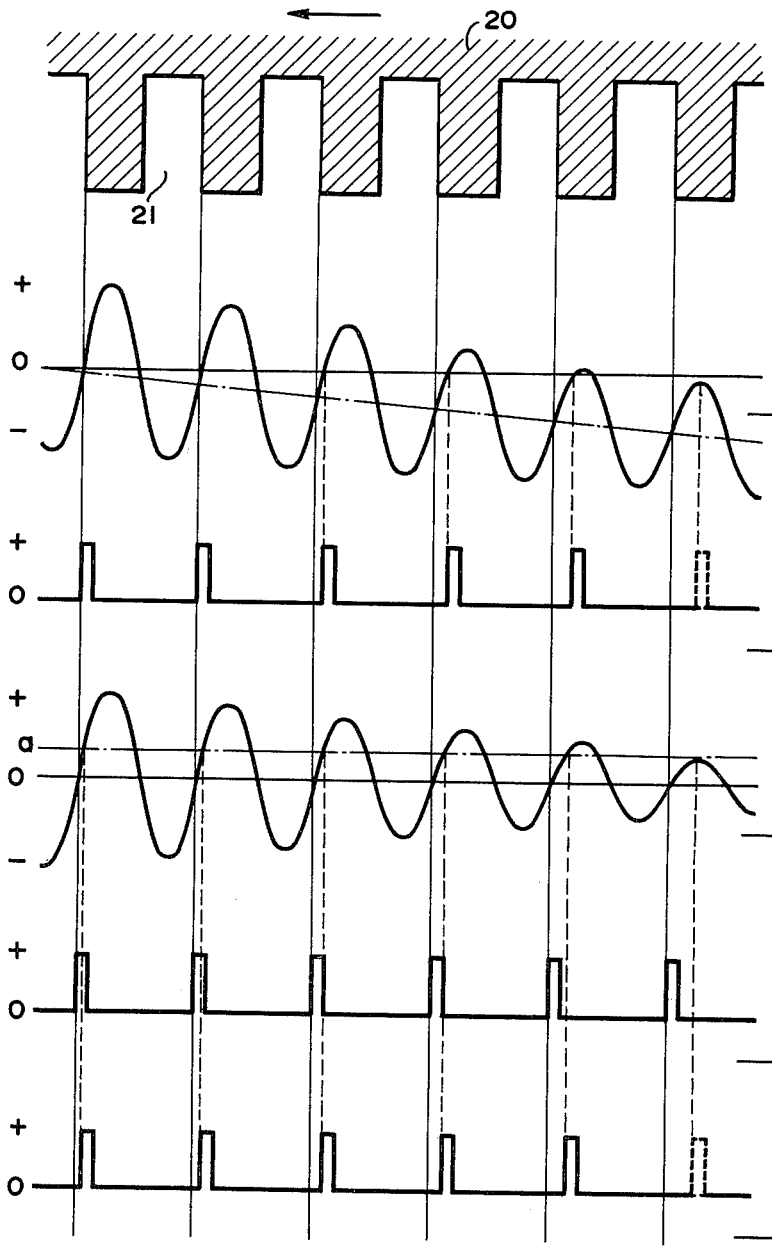
FIG. 5A, 5B, 5C, 5D, 5E, 5F is a schematic view showing waveforms of signals which are consulted for explaining how error signals occur.

Referring then to FIG. 5, it will be clarified how such irregular signals occur. FIG. 5A is an enlarged view showing a series of several needle grooves 21, and FIG. 5B is an enlarged view showing a waveform of a signal *e*1. In circular knitting machines, a reference input signal is derived from the signal *e*1 and supplied to the needle selector means. In forming this reference input signal, the signal *e*1 is shaped by a pulse shaper to a pulse signal. It is known that the pulse shaper is actuated by a properly selected potential. Assuming in FIG. 5B that the pulse shaper is actuated by a "0" potential to supply a pulse signal, the pulse signal has a phase difference relative to a corresponding needle groove 21 as shown in FIG. 4C, said phase difference being substantially equivalent to the amount of deviation of the waveform from its center line due to the eccentric needle cylinder. This causes reference input signals not exactly to be synchronized with corresponding cylinder needles. FIG. 5D indicates a signal which has no such waveform but has a ridge and a trough formed by signals of different amplitudes. If the pulse shaper is actuated by a 0 potential in this case, it supplies a pulse signal shown in FIG. 5E which is exactly synchronized with a corresponding needle groove 21. If the pulse shaper is actuated by other than the 0 potential, suuch as an *a* potential shown in FIG. 5D, a pulse signal has a phase difference shown in FIG. 5F as described with reference to FIGS. 5B and 5C.

Figure 6:
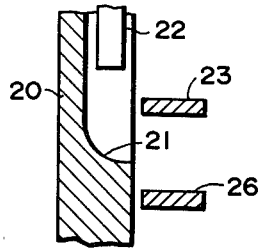
FIG. 6 is a sectional view taken along the line VI—VI of FIG. 2.

In accordance with the present invention, sensor means 26 is provided for sensing the eccentricity of the needle cylinder in addition to the sensor means 23 described earlier. The sensor 26 is constructed the same as the sensor 23, and is located as shown in FIG. 6. As best seen in FIG. 6, the sensor 26 is placed opposite the needle cylinder 20 in the area where needle grooves 21 are not extended and in alignment with the sensor 23 along the axial direction of the needle cylinder 20. The sensor 26 is intended to respond to changes in the gap between the sensor 26 and the peripheral surface of the needle cylinder 20, and supplies signals *e*2 shown in FIG. 4B which represent the changes in the gap or the deviation of the needle cylinder 20. It is clear that a signal *e*2 has the same phase as that part of the signal *e*1 which represents the eccentricity of the needle cylinder 20. As seen in FIG. 6, the sensor 26 is located opposite the non-channel or groove area of the needle cylinder 20, but may be placed opposite the grooves 21 provided that the sensor 26 is of a sufficiently greater size than a pitch between the two adjacent grooves or is placed a little more remote from the surface of the needle cylinder 20, so that the sensor 26 may produce signals which are not influenced by the presence of the needle grooves 21.

Figure 4D:
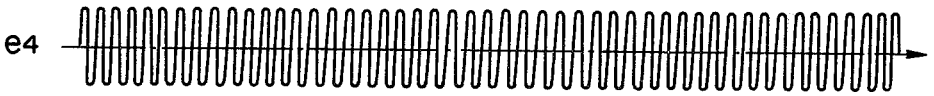
Figure 7:
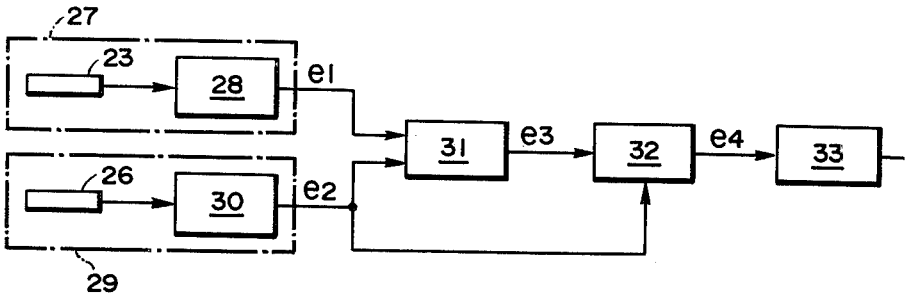
FIG. 7 is a block diagram of a preferred embodiment of the present invention.

FIG. 7 indicates a schematic diagram of a synchronizing signal generator according to the invention. In FIG. 7, a sensing station 27 includes a sensor means 23 and an amplifier/converter circuit 28, and supplies signals *e*1. A sensing station 29 includes sensor means 26 and an amplifier/converter circuit 30, and supplies signals *e*2. Those signals *e*1 and *e*2 are supplied to a difference operational circuit 31 which removes that part of the signal *e*1 which represents the eccentricity of the needle cylinder 20 and supplies a synchronizing signal *e*3. It is apparent from FIG. 4C that the signal *e*3 have no waveform earlier mentioned and formed by the cylinder eccentric signals, but still has different amplitudes. Therefore, this signal *e*3 is not suitable as a reference input signal which should be applied to the needle selector means as described by referring to FIGS. 5D and 5E. Those different amplitudes occur due to the eccentric needle cylinder as described earlier, so that the signal *e*3 is supplied to a gain control circuit 32 shown in FIG. 7 which controls the amplitudes of the signal *e*3 under the control of the signal *e*2. As shown in FIGS. 4B and 4C, if a signal *e*2 has a greater value, the signal *e*3 has a greater amplitude, and if the signal *e*2 has a smaller value, the signal *e*3 has a smaller amplitude. From this relationship, it is possible to control the amplitudes of the signal *e*3 by lowering the gain of the gain control circuit 32 if the signal *e*2 has a greater value, and by increasing the gain of the same circuit if the signal *e*2 has a smaller value. FIG. 4D indicates a signal *e*4 whose amplitude is controlled which is applied to a pulse shaper 33 shown in FIG. 7 which shapes a reference input signal of a waveform to be supplied to the needle selector means.

Figure 8:
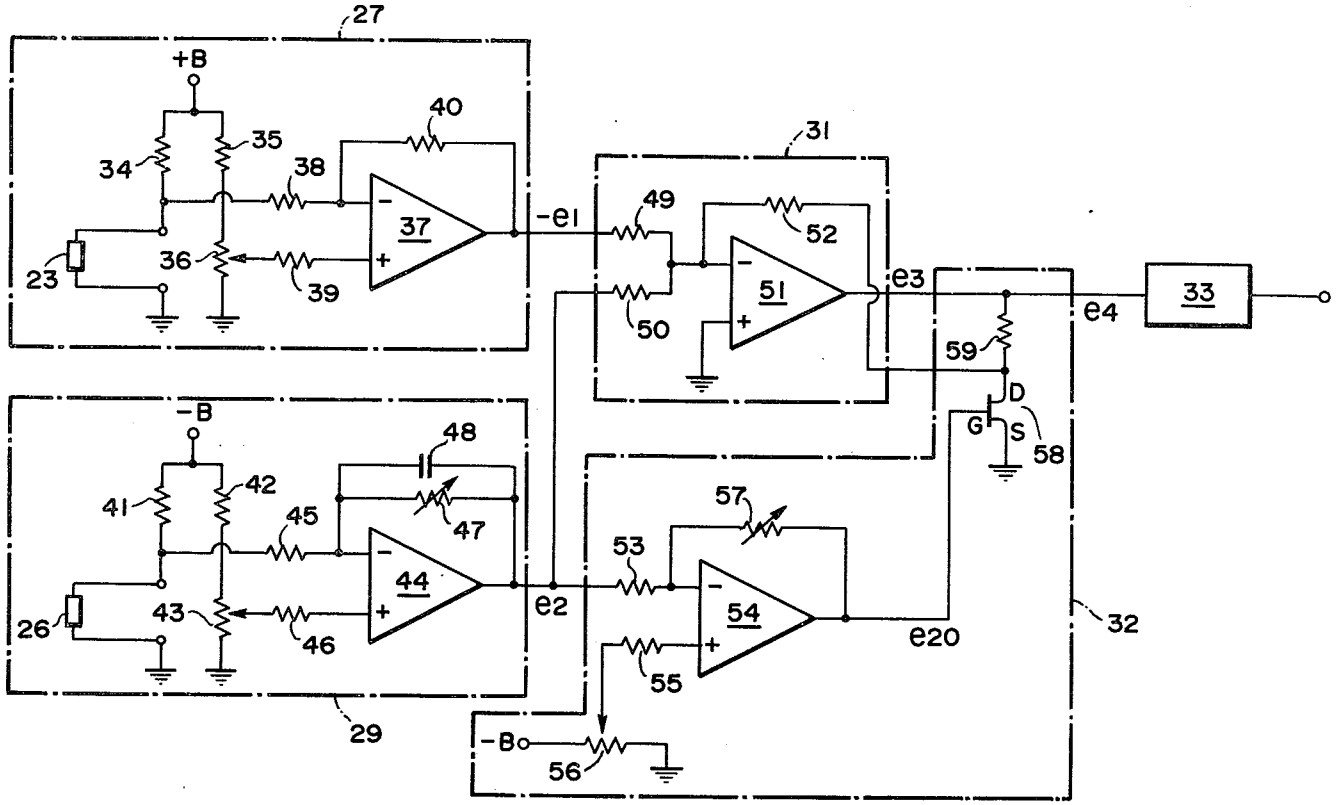
FIG. 8 is a detailed circuit diagram of FIG. 7.

FIG. 8 indicates in details the arrangement of a synchronizing signal generator according to the present invention. In the sensing station 27, the sensor 23 including an element of magnetoresistance for example produces signals which carry different values of the resistance varying with the magnetic flux density passing through the element, and is therefore connected to resistors 34, 35 and a variable resistor 36 to form a bridge which converts to voltage signals. The variable resistor 36 is best suited to adjust the bridge to zero point. The voltage signals are amplified by an inverting amplifier consisting of a difference amplifier 37 and resistors 38, 39 and 40 so that signals −*e*1 are supplied. As is the case with the sensing station 27 just described, the sensing station 29 has a bridge formed by the sensor 26, resistors 41, 42 and a variable resistor 43 which converts to voltage signals. The voltage signals are amplified by an inverting amplifier consisting of a difference amplifier 44, resistors 45, 46, a variable resistor 47 and a capacitor 48 to form signals +*e*2. The variable resistor 47 is best suited to adjust the amplification degree of the inverting amplifier, and the capacitor 48 is also best suited to eliminate high-frequency noises.

It should be noted that a voltage "+B" is applied across the bridge of the sensor station 27 and a voltage "−B" is applied across the bridge of the sensor station 29. As the two bridges receive a voltage of opposed polarity, the sensor station 27 has a signal "−*e*1" of a different polarity from the signal in FIG. 4A appearing at the output thereof. This makes it easy to perform the add operation as described below. Signals -*e*1 and *e*2 are applied through their respective resistors 49 and 50 to an operational circuit 31 consisting of an add inverting amplifier 51 and a resistor 52. As the two signals have an opposed polarity as mentioned earlier, the operational circuit 31 supplies a synchronizing signal *e*3 which represents a difference between the two signals, and eliminates that part of the signal which represents the eccentricity of the needle cylinder.

The signal *e*2 is applied through a resistor 53 to a difference amplifier 54 which forms an add inverting amplifier circuit together with a resistor 55, and variable resistors 56 and 57. The circuit controls the gain of the signal *e*2 and inverts the signal *e*2 to supply a signal *e*20 whose gain is corrected by adding the previously selected negative voltages −B applied through the variable resistor 56. This signal e20 is applied to a source terminal of FET 58 and changes the resistance between the drain and source terminals of the FET 58. The drain terminal of the FET 58 is connected through a resistor 59 to a line of the signal *e*3 and is also connected to a feedback resistor 52 of the operational circuit 31 so that the signal *e*20 has a voltage varying between −3v and 0v. With the increased voltage of the signal *e*20, the gain control circuit has its increased gain which corresponds to the ridge of the signal in FIG. 4B, and has its decreased gain which corresponds to the trough of the signal shown in FIG. B so that the signal *e*3 has its amplitude controlled. A signal *e*4 is thus obtained in accordance with the invention, and is applied to the pulse shaper 33 which shapes a reference input pulse signal to be supplied to the needle selector means.

Figure 9:
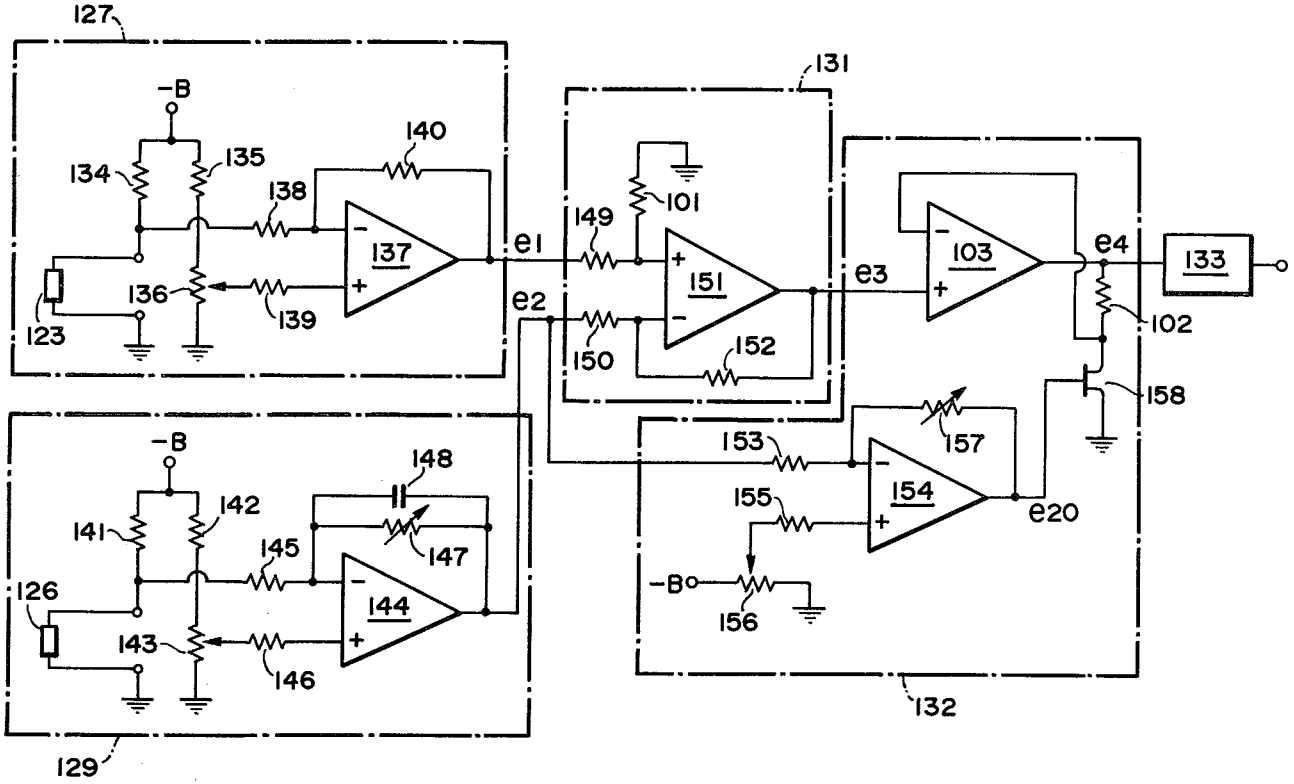
FIG. 9 is a circuit diagram of another preferred embodiment of the present invention.

FIG. 9 indicates a schematic diagram of another preferred embodiment of the synchronizing signal generator. This embodiment is substantially similar to the embodiment earlier described with reference to FIG. 8, except that a needle synchronizing signal and an eccentric cylinder signal have the same polarity and are operated so that a difference signal may be obtained. A sensor station 127 and a sensor station 129 have the same circuit arrangement as those 27 and 29 described with reference to FIG. 8, respectively. The difference is that a negative voltage − B is applied across the bridge of the sensor station 127 so that signals *e*1 and *e*2 of positive polarity are supplied. The operational circuit 131 constitutes a difference operational circuit which consists of a resistor 149, a difference amplifier 151 and other elements shown. The signal *e*1 is applied through the resistor 149 to an inverting input terminal of the difference amplifier 151 while the signal *e*2 is applied through the resistor 150 to a non-inverting input terminal of the amplifier 151. The difference amplifier 151 supplies a synchronizing signal *e*3 shown in FIG. 4C from which that part of the signal *e*1 which represents the eccentric cylinder is removed by subtracting the signal *e*2 from the signal *e*1. The inverting input terminal of the difference amplifier 151 is earthed through the resistor 101. The signal *e*2 is further applied to a gain control circuit 132 in which the difference amplifier 154 supplies an inverted signal *e*20 whose gain is controlled in the same manner as described in the earlier embodiment. The signal *e*20 is then applied to a gate of FET 158, and changes the resistance between the drain and source terminals of the FET 158. The drain terminal of the FET 158 is connected in series with the resistor 102 through which it is connected to the output of a non-inverting amplifier 103 with the source terminal earthed. The FET 158 has a point of junction between the FET 158 and the resistor 102, said point of junction leading to the non-inverting input terminal of the amplifier 103 for forming a negative feedback path to the amplifier 103. If the resistance between the drain and source terminals of the FET 158 decreases with the increased voltage of the signal *e*20 whose gain is corrected (shown by the trough of the signal in FIG. 4C), the amplifier 103 decreases the rate of the negative feedback and increases its gain. Reversely, if the resistance increases with the decreased voltage of the signal e20 whose amplitude is controlled (shown by the ridge of the signal in FIG. 4C), the amplifier 103 increases the rate of the negative feedback and decreases its gain. As a result, the signal *e*3 applied to the non-inverting amplifier 103 forms a signal *e*4 whose gain is controlled (shown in FIG. 4D) which is then applied to a pulse shaper 133 which shapes a reference input pulse signal to be applied to the needle selector means.

In accordance with the present invention which has been described in details, synchronizing signals from which those parts due to the eccentric needle cylinder are removed and which are exactly synchronized with the rotary movement of the cylinder needles can be supplied to the needle selector means so that the needle selector means are actuated at a very high speed with great accuracy and without error. This permits a very high-speed circular knitting machine to be achieved.

It is apparent that various modifications and changes may be made without departing from the scope and spirit of the invention.

We claim:

1. A synchronizing signal generator for high-speed circular pattern knitting machines comprising a needle synchronizing signal sensing station including a synchronous sensor for producing signals which are synchronized with each of a series of cylinder needles mounted on a needle cylinder, a needle cylinder eccentricity sensing station including a sensor provided in alignment with said synchronous sensor along the axial direction of the cylinder for producing signals which represent the eccentricity of the needle cylinder, a difference operational circuit which supplies difference signals between the needle synchronizing signals and the cylinder eccentricity signals, and a gain control circuit which controls the gains of said difference signals with said cylinder eccentricity signals.

2. A synchronizing signal generator according to claim 1 wherein said synchronous sensor and said cylinder eccentricity sensor include an element of magnetoresistance, respectively.

3. A synchronizing signal generator according to claim 2 wherein said synchronous sensor and said cylinder eccentricity sensor have their respective element of magnetoresistance connected to one pole of a corresponding permanent magnet, and are located in close proximity of the needle cylinder.

4. A synchronizing signal generator according to claim 3 wherein each of the elements of magnetoresistance provided in said synchronous sensor and said cylinder eccentricity sensor forms one element of a bridge circuit, said bridge circuits converting the changes of the resistance of said elements to voltage signals, respectively.

5. A synchronizing signal generator according to claim 4 wherein said bridge circuit receives reference voltages of opposite polarity.

6. A synchronizing signal generator according to claim 5 wherein said difference operational circuit includes an add operational inverter amplifier which receives two different signals of opposite polarity, one of which are produced by said needle synchronizing signal sensing station including said bridge circuit corresponding thereto and the other of which are produced by said needle cylinder eccentricity sensing station including said bridge circuit corresponding thereto.

7. A synchronizing signal generator according to claim 4 wherein said bridge circuit receives reference voltages of identical polarity.

8. A synchronizing signal generator according to claim 7 wherein said difference operational circuit includes a difference amplifier which receives two different signals of identical polarity one of which are produced by said needle synchronizing signal sensing station including said bridge circuit corresponding thereto and the other of which are produced by said cylinder eccentricity sensing station including said bridge circuit corresponding thereto.

9. A synchronizing signal generator according to claim 1 wherein said gain control circuit includes an amplifier which controls the gains of the cylinder eccentricity signals, and an FET element whose resistance between the drain and source terminals varies with the output of said amplifier.

* * * * *